United States Patent [19]

Grabner et al.

[11] 4,158,299

[45] Jun. 19, 1979

[54] DOOR LOCK FOR MOTOR VEHICLES

[75] Inventors: Christian Grabner, Gechingen; Rolf Krügener; Hermann W. Kurth, both of Sindelfingen, all of Fed. Rep. of Germany

[73] Assignee: Daimler-Benz Aktiengesellschaft, Fed. Rep. of Germany

[21] Appl. No.: 901,776

[22] Filed: May 1, 1978

[30] Foreign Application Priority Data

May 7, 1977 [DE] Fed. Rep. of Germany ..... 2720713

[51] Int. Cl.[2] ..... E05B 13/10

[52] U.S. Cl. ..... 70/224; 70/369; 70/DIG. 31

[58] Field of Search ..... 70/224, 367, 369, 216, 70/237, 376, 416, DIG. 15, DIG. 23, DIG. 31

[56] References Cited

U.S. PATENT DOCUMENTS

| | | | |
|---|---|---|---|
| 1,930,651 | 10/1933 | Lyons et al. | 70/224 X |
| 1,992,126 | 2/1935 | Hurd | 70/224 |
| 2,687,637 | 8/1954 | Jacobi | 70/224 |
| 3,011,331 | 12/1961 | Williams | 70/224 X |

*Primary Examiner*—Mervin Stein
*Assistant Examiner*—Carl Pietruszka
*Attorney, Agent, or Firm*—Craig and Antonelli

[57] ABSTRACT

A door lock for motor vehicles, in which a lock cylinder is connected with a lock tumbler by way of an insertable entrainment rod, whereby the lock cylinder is inserted together with a door handle into an aperture provided in the outer body panel of the door; an anti-theft device which is connected with the lock cylinder, engages from behind a locking projection provided at the door.

18 Claims, 3 Drawing Figures

DOOR LOCK FOR MOTOR VEHICLES

The present invention relates to a door-lock for motor vehicles with a lock cylinder which is operatively connected by way of an insertable entrainment rod with the lock tumbler arranged in the door and with the locking linkage and which is inserted together with the door handle into an aperture provided in the outer body panel of the door.

Door locks of this type are known in the art. In these prior art door locks, the lock cylinder is generally arranged directly in the mounting support for the door handle and is operatively connected with the lock tumbler by way of an entrainment rod constructed in the manner of a screw driver. The door handle and the lock cylinder are retained in the door in that a projection provided within the area of the lock cylinder engages from behind the door outer body panel, which is securely retained in this position by a screw or the like inserted into the end face of the door. Locks of this type permit a relatively simple assembly of the door handle. However, they entail the disadvantage that with non-locked vehicle doors, an unauthorized duplication of the keys is possible by a relatively simple disassembly of the lock cylinder.

The present invention is therefore concerned with the task to avoid this disadvantage of the known door locks and to so construct a lock that a disassembly of the outer door handle together with the lock cylinder is possible only when also the associated key is present. It is proposed according to the present invention as solution to the underlying problems that a latching hook or the like is connected with the lock cylinder, which engages behind a locking projection or the like provided at the door. By reason of this construction, it will not be possible, notwithstanding disengagement of the fastening screw for the door handle, to remove the door handle out of the door. For this purpose, the vehicle key must always be available, with the aid of which the lock cylinder can be so rotated that a disassembly and removal of the door handle is possible.

A particularly simple construction of the present invention results if the latching hook is arranged at the entrainment rod and the locking projection in the lock tumbler because an additional expenditure for the arrangement of locking and latching parts is then not necessary. The latching hook may thereby be arranged at the end of the entrainment rod approximately perpendicularly to the flattened off locking web of the entrainment rod, and the locking projection can be formed by an enlargement of the inside diameter or opening in the lock tumbler to the rear of the entrainment cross section. It is therefore only necessary to rotate the lock tumbler to the rear of the entrainment cross section correspondingly so that the latching hook is extended through the entrainment cross section and takes over the locking function after the insertion of the entrainment web for such length of time until the entrainment rod is again turned back with the aid of the key. The latching hook may appropriately be a latch or blocking web corresponding in its dimension to the locking web, which is arranged rotated by 90° with respect to the locking web, whereby an axial distance must exist between the locking web and the blocking web which correspcnds to the axial length of the locking projections. With this construction, the blocking web may be introduced at first into the lock tumbler during the assembly. By a rotation of the entrainment rod through 90°, the locking web is then introduced into the corresponding cross section in the lock tumbler. A disassembly is again possible only if the entrainment rod is at first pulled out of the lock tumbler so far that the locking web no longer abuts at its entrainment cross section whereupon the entrainment rod is then rotated with the aid of the vehicle key so far that also the latch or blocking web is adapted to be passed through the entrainment web.

It has been found to be advantageous if the locking projection is provided with two diametrally oppositely disposed cams or lugs directed inwardly from the inlet diameter of the lock tumbler, which include on oppositely disposed sides at least at two mutually parallel abutment walls for the locking web having an approximately rectangular cross section. The cams or lugs may also include two further inner walls extending parallel to one another but at an angle to the abutment walls so that a clearance is formed on the inside of the entrainment cross section which permits also an opening of the door by a corresponding inside actuating mechanism and enables an easy insertion of the end of the entrainment rod.

Since with the advantageous construction described so far, the possibility still exists under certain circumstances to pull out or tear out the door handle on the side opposite the lock cylinder with a corresponding force application, it is further advantageously provided according to the present invention that a blocking projection engaging the outer sheet metal panel of the door from behind is provided on the inside of the door handle. Any disassembly possibility of the door handle which proceeds without significant deformation that can be noticed without difficulty from the outside, is precluded with this type of construction.

Accordingly, it is an object of the present invention to provide a door lock for motor vehicles which avoids by simple means the aforementioned shortcomings and drawbacks encountered in the prior art.

Another object of the present invention resides in a door lock for motor vehicles which precludes the disassembly of the lock cylinder on the part of an unauthorized person to obtain duplicate keys.

A further object of the present invention resides in a door lock for motor vehicles which effectively minimizes the danger that duplicate keys can be readily made when the vehicle door is not locked, without informing the owner of the vehicle of this fact.

A still further object of the present invention resides in a door lock which permits the disassembly of the outer door handle together with the lock cylinder only when also in possession of the associated key.

Still another object of the present invention resides in a door lock for motor vehicles which is particularly simple in construction yet effectively reduces the likelihood of theft by the use of duplicate keys.

These and other objects, features and advantages of the present invention will become more apparent from the following description when taken in connection with the accompanying drawing which shows, for purposes of illustration only, one embodiment in accordance with the present invention, and wherein.

Figure 1:
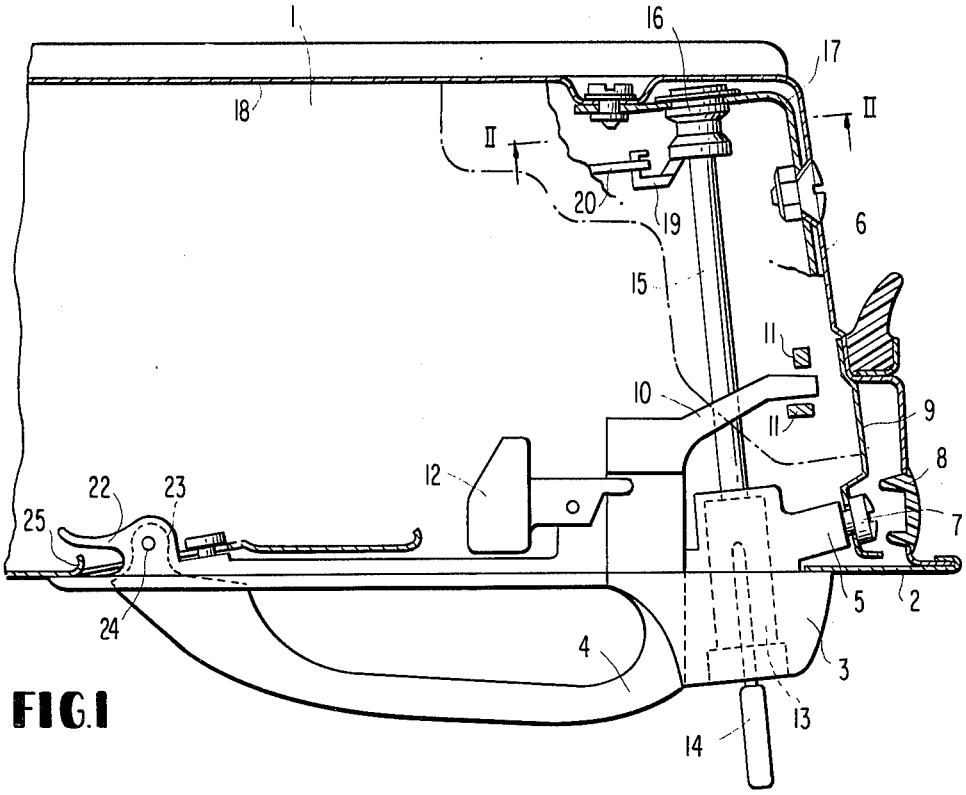
FIG. 1 is a partial somewhat schematic horizontal cross-sectional view through the door of a passenger motor vehicle equipped with a door lock in accordance with the present invention, the cross section being taken approximately at the height of the door handle.
Figure 2:
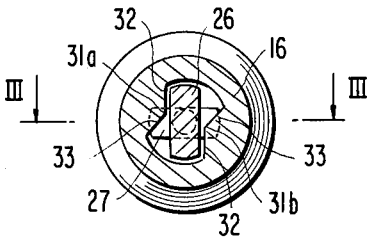
FIG. 2 is a vertical cross-sectional view through the lock tumbler of the door lock mechanism of FIG. 1, taken along line II—II in FIG. 1.
Figure 3:
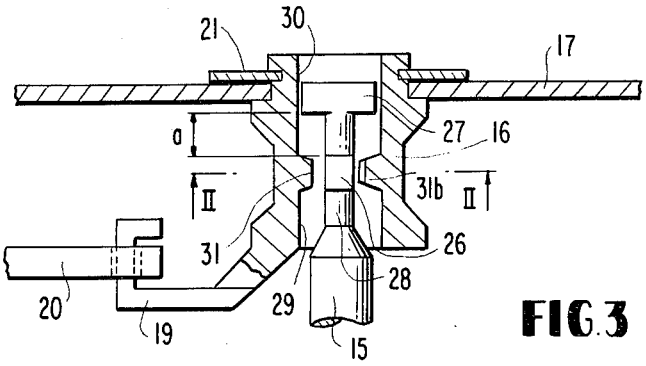
FIG. 3 is a partial horizontal cross-sectional view through the lock tumbler of FIG. 2 taken in the direction of line III—III in FIG. 2.

Referring now to the drawing wherein like reference numerals are used throughout the various views to designate like parts, a partial cross section of a passenger motor vehicle door 1 is shown in FIGS. 1 to 3, in the outer body panel 2 of which is provided an aperture, into which is inserted the mounting support 3 for a door handle 4. The mounting support 3 is provided on the inside of the outer sheet metal body panel 2 with a fastening part 5 engaging the outer sheet metal body member 2 from behind, the fastening part 5 is secured at the end face wall 6 of the door 1 by means of one or two screws 7, which are accessible from the end face of the door after removal of the closure plug 8. In the illustrated embodiment, the screw 7 retains the fastening part 5 at a wall section 9 provided at the end wall 6.

In addition to the door handle 4, which is operatively connected with the outside actuating levers 11 of the door lock by way of an entrainment member 10 and which is equipped with a mass compensating weight 12, also the lock cylinder 13 shown in FIG. 1 in dash lines is arranged in the mounting support 3. In the illustrated embodiment, the vehicle key 14 is shown inserted into the lock cylinder, with the aid of which the entrainment rod 15 non-rotatably connected with the lock cylinder 13 can be rotated. The entrainment rod 15 engages with the lock tumbler 16 in the manner to be described more fully hereinafter by reference to FIGS. 2 and 3; the lock tumbler 16 is thereby rotatably arranged at a sheet-metal mounting member 17 within the area of the inner sheet-metal body panel 18 of the door. The lock tumbler 16 is operatively connected by way of an arm 19 securely connected therewith with a locking lever 20 which leads to the locking linkage of the door lock in a conventional manner (not illustrated). The lock tumbler 16 is retained at the sheet-metal fastening member 17 in that it extends with an extension thereof through an opening in the sheet-metal fastening member 17 and is rotatably retained at the sheet-metal fastening member 17 by a counter disk 21 suitably secured thereto (FIG. 3).

The mounting support 3 together with the door handle 4 is additionally provided on the side opposite the lock cylinder 13 with a stop or blocking nose 22 (FIG. 1) which is provided at the bearing part 23 for the door handle 4 that is pivotal about the bolt 24. This blocking nose portion or stop projection 22 overlaps with and extends beyond the left edge 25 of the aperture on the outer sheet-metal member 2. The mounting support 3 together with the door handle 4 is therefore placed during the assembly at first with the blocking nose portion or stop projection 22 behind the end 25 of the outer sheet metal member 2, and then with simultaneous insertion of the free end of the entrainment rod 15 into the lock tumbler 16, is pushed together with the fastening part 5 behind the right side of the aperture in the outer sheet metal member 2 so that the fastening part 5 can be subsequently moved toward the right together with the mounting support 3 and can be secured by the screw 7. A disassembly of this door handle 4 with its mounting support 3 would therefore be possible without difficulty in the reverse sequence after the disengagement of the screw 7.

However, in order to prevent this, the end of the entrainment rod 15, which engages in the lock tumbler 16, is provided not only with the usual locking web 26 that has an approximately rectangular cross section, but additionally also with an additional latch or blocking web 27 which projects from the thinner end 28 of the entrainment rod 15 offset at an angle of 90° to the locking web 26. The mutually facing end faces of locking web 26 and blocking web 27 thereby have an axial distance a to one another. The lock tumbler 16 is provided on its inside with two bore sections 29 and 30 (FIG. 3) which have the same diameter but which are separated from one another by a locking projection 31 whose axial length must be smaller than the axial distance a between the locking web 26 and the blocking web 27. As can be seen in detail from FIG. 2, the locking projection 31 is formed in that two approximately diametrically oppositely disposed cams or lugs **31*a* and 31*b* are provided which include two abutment wall portions 32 extending parallel to one another and two inner wall portions 33 extending at an angle to the abutment wall portions 32 but again parallel to one another. In this manner, not only the locking cross section is formed which makes it impossible in the illustrated position to pull the entrainment rod 15 out of the lock tumbler 16. Also a clearance for the locking web 26 is formed which permits an actuation of the lock tumbler 16 without influencing the entrainment rod 15 and the lock cylinder 13**, as must be possible, for example, from the inside of the vehicle.

Consequently, the door handle 4 constructed in accordance with the present invention and the mounting support 3 thereof can be disassembled from the illustrated installed position thereof only if at first the screw 7 is loosened or disengaged in the usual manner, and if thereafter the mounting support 3 is displaced toward the left until the fastening part 5 can be moved over the right edge of the aperture in the outer sheet metal member 2. Thereupon, the mounting support 3 together with the entrainment rod 15 has to be pulled out of the lock tumbler 16 so far until the locking web 26 is pulled out of the locking cross section 31 and the end wall of the latching or blocking web 27 facing the outer sheet metal member 2 abuts at the lugs **31*a* and 31*b*. By actuation of the driver key 14, the entrainment rod 15 can then be so rotated that also the blocking web 27 can be pulled through the locking projections 31. Subsequently thereto, the mounting support 3 has to be moved again slightly toward the right so that also the blocking projection 22 can be taken out of the aperture in the outer sheet metal member 2. For purposes of assembly, one has to proceed in the inverse manner. Also in this case the vehicle key has to be present. However, it has been found that the assembly is relatively simple because also the blocking web 27 can be readily inserted into the locking cross section 31 with a corresponding actuation of the vehicle key 14 and can then be brought into a position by rotation of the vehicle key in which the locking web 26 is able to enter readily between the abutment wall parts 32**. Since additionally a clearance exists at this place, no difficulty exists for the assembly.

The described embodiment, however, offers the great advantage that a disassembly is not possible when the vehicle key 14 is not available. The heretofore known theft method by disengagement of the screw 7 will be rendered impossible since the entrainment rod 15 cannot be removed out of the lock tumbler 16. Also, the forcible tearing out of the door handle 4 will be effectively prevented by the blocking projection 22 so that also a damage of the area of the lock tumbler 16 is prevented with such a forcible interaction.

It would, as such, also be possible for the theft protection to provide a safety pin at right angle to the longitudinal axis of the lock cylinder 13, which engages behind the outer sheet-metal door panel 2 or behind corresponding parts and permits a disassembly only when the lock cylinder is rotated correspondingly. However, this construction is more costly compared to the illustrated embodiment, especially as the mounting support 3 or even the outer sheet-metal door configuration then has to be realized differently from that of heretofore known doors. The construction of the entrainment rod and of the lock tumbler, in contradistinction thereto, can be realized in the present invention without significant change of the type of construction used heretofore.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A door lock for motor vehicles, comprising a lock cylinder means which is operatively connected by way of an insertable entrainment rod means with a lock tumbler means arranged in the door and with locking linkage means, said lock cylinder means being inserted together with a door handle into an aperture provided therefor in an outer body panel of the door, characterized in that an anti-theft means is operatively connected with the lock cylinder means, said anti-theft means engaging a locking means provided at the door from behind.

2. A door lock according to claim 1, characterized in that the anti-theft means is a latching hook which engages a locking projection at the door from behind.

3. A door lock according to claim 2, characterized in that the latching hook of the anti-theft means is arranged at the entrainment rod means.

4. A door lock according to claim 3, characterized in that the locking projection of the locking means is arranged in the lock tumbler means.

5. A door lock according to claim 4, characterized in that the latching hook of the anti-theft means is arranged at the end of the entrainment rod means approximately perpendicularly to a flattened off locking web of the entrainment rod means, and in that the locking projection of the locking means is formed by a reduction of the dimensions of an internal opening in the lock tumbler means to the rear of the entrainment cross section thereof.

6. A door lock according to claim 5, characterized in that the latching hook of the anti-theft means is a blocking web corresponding in its dimensions to the locking web and arranged rotated by 90° with respect to the locking web, and in that an axial distance exists between the locking web and the blocking web which is at least equal to the axial length of the locking projection of the locking means.

7. A door lock according to claim 6, characterized in that said axial distance is greater than the axial length of the locking projection of the locking means.

8. A door lock according to claim 6, characterized in that the locking projection of the locking means is provided with two approximately diametrally opposite lugs directed inwardly from the inlet diameter of the lock tumbler means, which include mutually substantially parallel abutment wall portions at least on two oppositely disposed sides for the locking web having an approximately rectangular cross section.

9. A door lock according to claim 8, characterized in that the lugs include two further inner wall portions extending substantially parallel to one another but at an angle to the abutment wall portions.

10. A door lock according to claim 9, characterized in that a blocking projection which engages the outer body panel of the door from behind is provided on the inside of the door handle opposite the lock cylinder means.

11. A door lock according to claim 1, characterized in that the anti-theft means is arranged at the entrainment rod means.

12. A door lock according to claim 1 or 11, characterized in that the locking means is arranged in the lock tumbler means.

13. A door lock according to claim 1, characterized in that the anti-theft means is arranged at the end of the entrainment rod means approximately perpendicularly to a flattened off locking web of the entrainment rod means, and in that the locking means is formed by a reduction of the dimensions of an internal opening in the lock tumbler means to the rear of the entrainment section thereof.

14. A door lock according to claim 1 or 13, characterized in that the anti-theft means is a blocking web corresponding in its dimensions to the locking web and arranged rotated by 90° with respect to the locking web, and in that an axial distance exists between the locking web and the blocking web which is at least equal to the axial length of the locking means.

15. A door lock according to claim 1 or 13, characterized in that the locking means is provided with two approximately diametrically opposite lugs directed inwardly from the inlet diameter of the lock tumbler means, which include mutually substantially parallel abutment wall portions at least on two oppositely disposed sides for the locking web having an approximately rectangular cross section.

16. A door lock according to claim 15, characterized in that the anti-theft means is a blocking web corresponding in its dimensions to the locking web and arranged rotated by 90° with respect to the locking web, and in that an axial distance exists between the locking web and the blocking web which is at least equal to the axial length of the locking means.

17. A door lock according to claim 16, characterized in that the lugs include two further inner wall portions extending substantially parallel to one another but at an angle to the abutment wall portions.

18. A door lock according to claim 1, characterized in that a blocking projection which engages the outer body panel of the door from behind, is provided on the inside of the door handle opposite the lock cylinder means.

* * * * *